United States Patent [19]

Spitz

[11] 4,398,311

[45] Aug. 16, 1983

[54] FOLDING SOFA-BED MECHANISM

[75] Inventor: Melvin P. Spitz, Beverly Hills, Calif.

[73] Assignee: Kinematic Industries, Inc., Whittier, Calif.

[21] Appl. No.: 264,269

[22] Filed: May 18, 1981

[51] Int. Cl.[3] ..... A47C 17/04

[52] U.S. Cl. ..... 5/13; 5/28; 5/13; 5/44 R

[58] Field of Search ..... 5/13, 23, 42, 28–36, 5/44, 48, 51 F, 51 J

[56] References Cited

U.S. PATENT DOCUMENTS

| | | | |
|---|---|---|---|
| 1,945,186 | 1/1934 | Frank | 5/36 |
| 3,150,384 | 9/1964 | Helton | 5/13 |
| 3,868,733 | 3/1975 | Spitz et al. | 5/29 X |

FOREIGN PATENT DOCUMENTS

| | | | |
|---|---|---|---|
| 281696 | 3/1952 | Switzerland | 5/42 |

*Primary Examiner*—Francis K. Zugel
*Assistant Examiner*—Michael F. Trettel

[57] ABSTRACT

A folding bed frame for sofa-beds in which a plurality of frame sections, including a foot section, knee section, body section and head section are pivoted in end-to-end relation so as to be foldable between an extended bed-forming position and a retracted sofa seat-forming position; wherein front and rear support and guiding link assemblies coact to control movements of the body section and head section during movements to the extended bed-forming position and to the retracted sofa seat-forming position. The link assemblies are supported by front and rear anchor links, the front anchor link being pivotally supported at its inner end at a front pivot point on an anchor frame plate and the rear anchor link being a rocker lever pivotally supported between its inner and outer ends at a rear pivot point on the anchor frame plate in substantially horizontal alignment with the front pivot point. A control link is pivotally connected to the front anchor link on one side of the front pivot point and to an end of the rear anchor link on an opposite side of the rear pivot point. The mounting arrangement operates to move the frame sections, during folding and unfolding operations, through a path having greater floor clearance, and thus permits a number of advantageous changes such as increased bed length and greater depth of the space for the folded mattress, while still utilizing the restricted dimensions dictated by the furniture framing structure.

26 Claims, 9 Drawing Figures

FIG. 3.
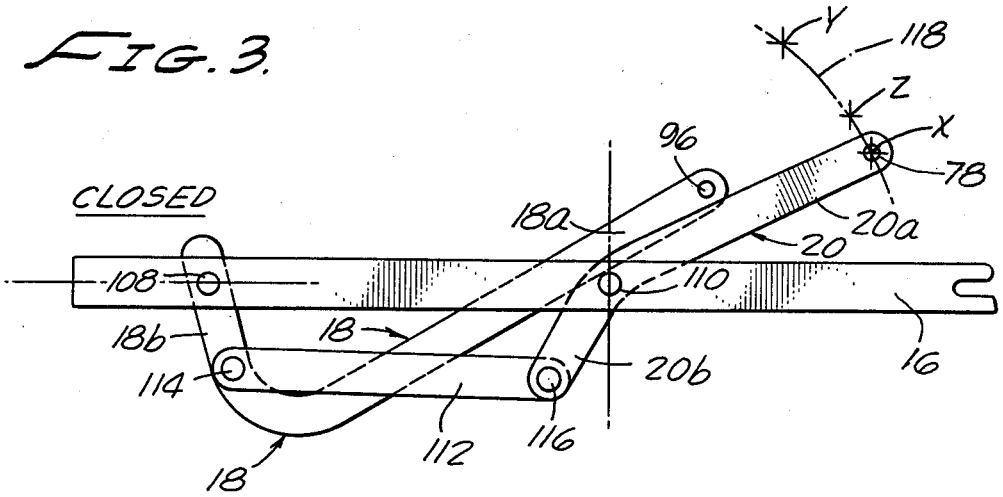
FIG. 4.
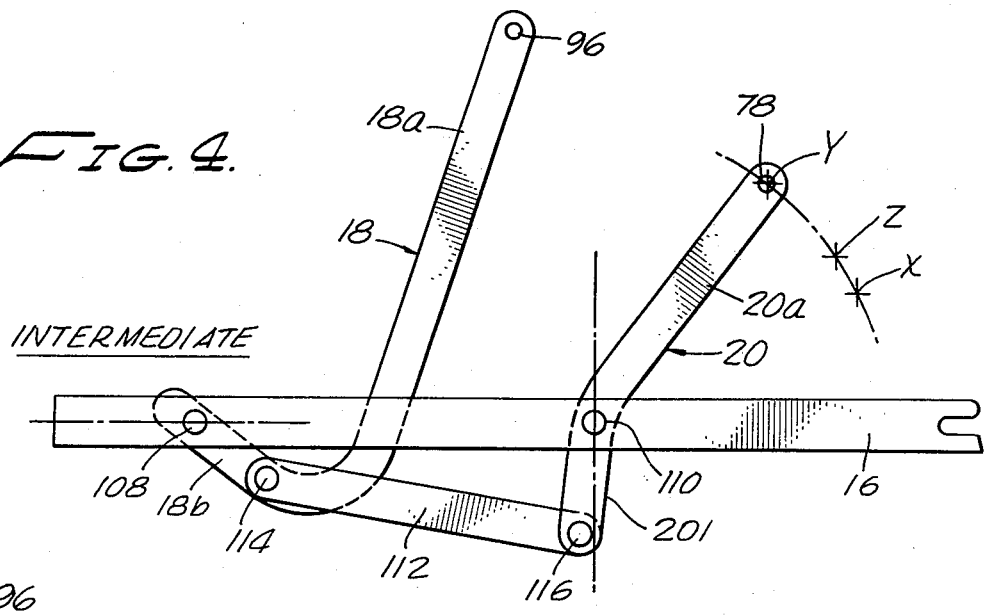
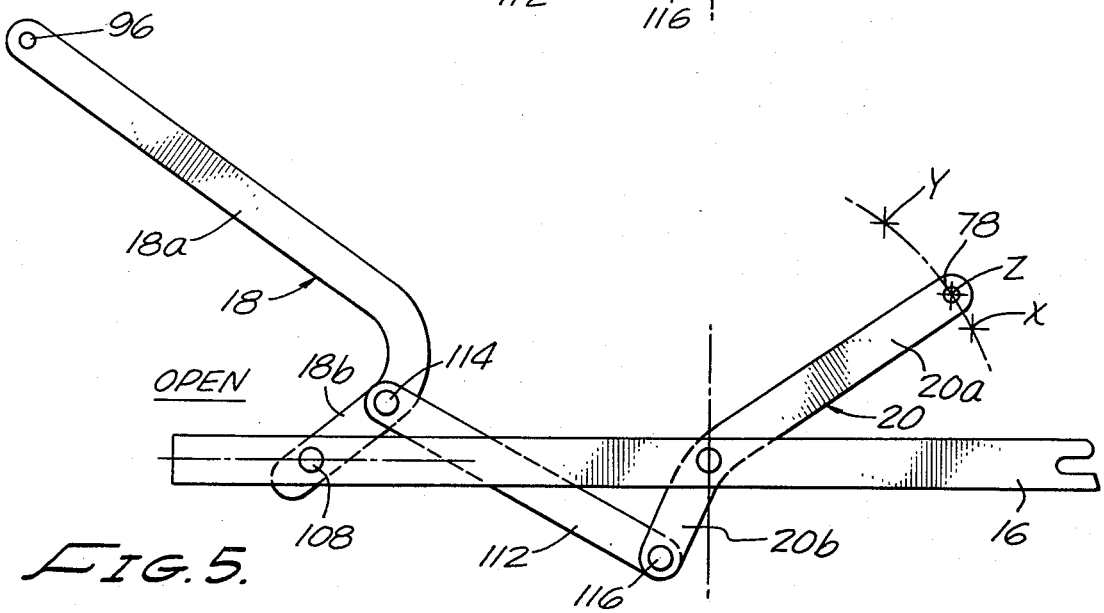
FIG. 5.

FOLDING SOFA-BED MECHANISM

BACKGROUND OF THE INVENTION

The present invention relates generally to the field of articulated bed frames.

It has been generally known heretofore from a number of known arrangements to provide sofa-bed structures in which pivotally connected bed sections could be selectively actuated into an extended bed-forming position or into a sofa seat-forming position. Exemplary of these constructions is the arrangement disclosed in the Spitz, et al U.S. Pat. No. 3,868,733 which discloses a plurality of frame sections, including a foot section, knee section, trunk section and head section pivoted in end-to-end relation, the trunk section being supported upon forward and rearward support assemblies, and the head section being operatively connected through a linkage mechanism such that during folding and unfolding operations of the bed frame, the head section will be moved so as to occupy a substantially horizontal position when the bed frame sections are in a bed-forming position, and a substantially vertical position when the bed frame sections are moved into a sofa seat-forming position.

Characteristic of the foregoing embodiments is the utilization of a front guiding link assembly for the trunk section which is pivotally connected with the upper end of a front upstanding anchor link having its lower end pivoted at a front pivot point on a stationary anchor frame plate. A rear guiding link assembly for the trunk section is also pivotally connected with the upper end of an upstanding fixed rear bracket attached to and extending above a rear end portion of the stationary anchor frame plate.

Other patents have also been known, as exemplified by the disclosure in the Mikos U.S. Pat. No. 3,516,096 in which pivoted front and rear support links are interconnected by a control link on the same side of the respective bottom pivots of the front and rear support links. This control link in effect ties the support links together so that they are operatively maintained in substantially parallel relation and so that their pivotal movements will always be in the same direction.

Another known concept for the mounting of pivotally swingable front and rear support links or levers is that exemplified by the arrangement disclosed in the Mikos U.S. Pat. No. 4,253,205 in which the rear support lever means has a movable supporting pivot, and the control link means, which are connected between the front and rear support lever means are operable to control the movement of the rear support lever means as the bed frame is moved between extended and retracted positions. In the disclosed arrangement, two control links are utilized. One link interconnects the front and rear support levers in a manner similar to that disclosed in the above mentioned U.S. Pat. No. 3,516,096 while the other link is connected to the movable supporting pivot of the rear support lever and acts to movably shift its position forwardly and rearwardly along a horizontal slot in the mounting frame member.

From a careful consideration of the best known linkage mechanisms in the folding bed-sofa art, and in particular the arrangements disclosed in the patents as previously noted above, it became apparent that the currently known structures could advantageously be improved in a number of areas, and in particular that such improvements should preferably include the following objectives:

A. To increase the floor clearance of the frame sections during their articulated folding and unfolding movements;

B. To lower the rear portion of the closed bed frame in relation to the floor; and C. To dispose the extended open bed frame at a more desirable position forward of the associated upholstered back-rest, and at a more desirable height above the floor.

By achieving these objectives, two improved new product features are susceptible of attainment, namely:

1. The length of the open bed can be increased, while at the same time retaining the articulated movements of the mechanism within the restricted and confined dimensions dictated by the associated furniture frame structure.
2. The depth of the space provided within the folded frame structure for the folded mattress can be increased, while at the same time retaining a relatively low seat level with the desired rake or pitch.

In the present invention, these objectives and product features are made possible by the provision of unique coacting front and rear pivoted anchor links for controlling movements of the articulated bed frame sections during the folding and unfolding operations. For such purpose, the front anchor link is pivoted at its inner end at a front pivot point on an anchor frame plate. The rear anchor link comprises a rocker lever which is pivoted between its inner and outer ends at a rear pivot point on the anchor frame plate. A control link coordinates the movement of the front and rear anchor links, this control link being connected at one end to the front anchor link at a point adjacent its mounting pivot, and at its other end to the end of the rear anchor link that extends below its mounting pivot. As thus arranged, movement of the front anchor link, during movement of the frame sections between their fully folded and fully unfolded positions will cause the rear anchor link to successively move in one direction to carry the connected frame sections from a relatively lower elevation to an increased elevation, and then by a reversed direction of movement return the frame sections again to a relatively lower elevation.

SUMMARY OF THE INVENTION

The present invention relates generally to beds of the type having an articulated sectional bed frame, and more particularly to an improved linkage mechanism for actuating and controlling swinging movements of the bed frame sections as they are moved between a bed-forming and a sofa seat-forming position.

Among the various objects of the herein described invention, it is one object to provide a unique arrangement in which opening and closing movements of the frame sections will be controlled by interconnected coacting pivotally supported front and rear anchor links in such a manner as to provide greater floor clearance, and thereby enable modification of the frame sections in a manner to provide bed structures of longer length than heretofore possible.

A further object is to provide an improved support for an articulated bed frame, which will enable increasing of the depth of the space for the folded mattress, while still utilizing the restricted dimensions dictated by the associated furniture framing structure.

Another object resides in the provision of an improved support for an articulated bed frame structure in which the folding and unfolding movements are controlled by coactingly interconnected pivotally supported front and rear anchor links, and in which the rear anchor link constitutes a rocker type lever.

Further objects of the invention will be brought out in the following part of the specification, wherein detailed description is for the purpose of fully disclosing the invention without placing limitations thereon.

BRIEF DESCRIPTION OF THE DRAWINGS

Referring to the accompanying drawings, which are for illustrative purposes only:

FIG. 3 is an enlarged fragmentary side elevational view illustrating the relative positions of the front and rear anchor links, and connecting control link, when the frame sections are in a retracted, closed position;

FIG. 4 is a similar view indicating the relative positions of the links at an intermediate operative position of the frame sections;

FIG. 5 is a similar view illustrating the position of the link elements, when the frame sections are in a fully extended open position;

DESCRIPTION OF THE DISCLOSED EMBODIMENT

Figure 1:
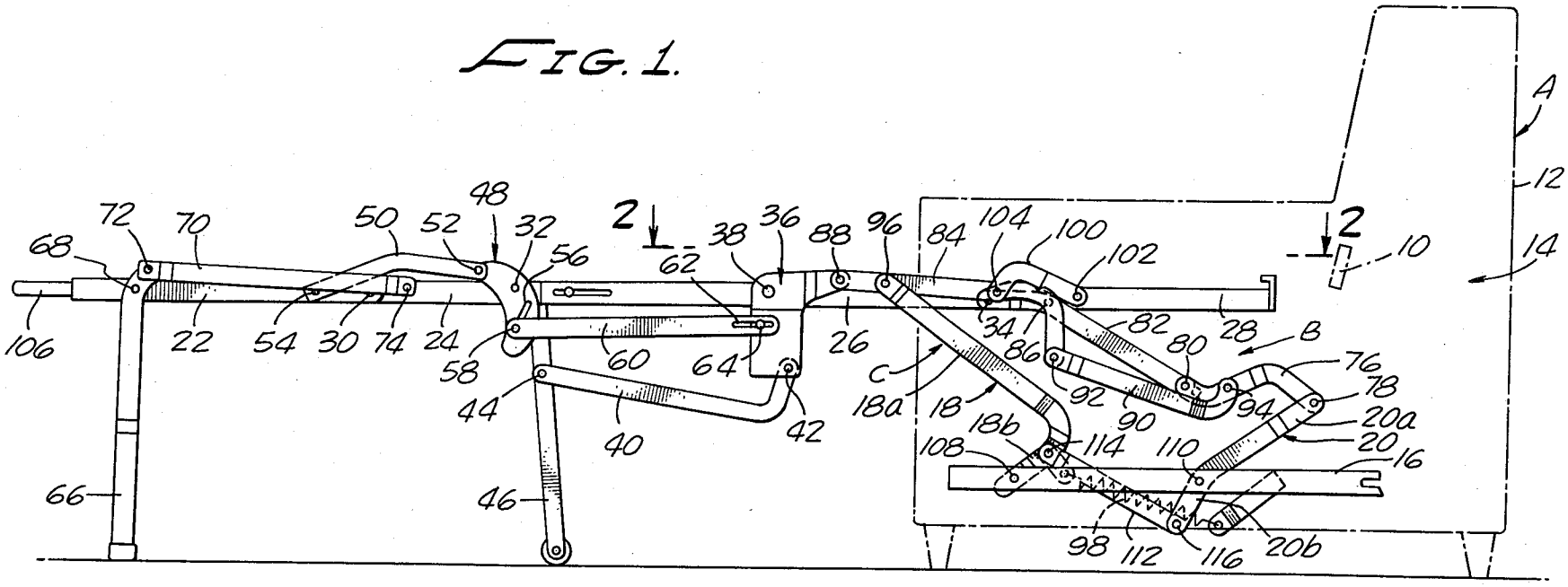
FIG. 1 is a side elevational view of a sofa-bed construction having a bed frame operatively controlled in accordance with the features of the present invention.

Referring more specifically to the drawings, the sofa-bed structure embodying the features of the present invention, as shown in FIG. 1, embodies a linkage actuating and control arrangement generally similar to that disclosed in the Spitz et at, U.S. Pat. No. 3,868,733, and which has been modified as will hereinafter be explained more fully so as to incorporate the features of the present invention. This patent is incorporated in the present application by reference.

The bed frame structure is arranged to be mounted in a conventional upholstered sofa structure as generally indicated in phantom lines at A. Such sofa structure usually comprises opposite end portions that are associated with a fixed wooden frame having a rearwardly spaced back center rail member 10 below and back of which certain parts of the articulated bed frame structure must be moved, when the bed frame is folded to a seat-forming position. The back center rail member is forwardly spaced with reference to a back wall 12 of the sofa structure and cooperates therewith to form a behind-the-back-rail space generally indicated at 14 and into which certain parts of the bed frame structure will be received, when in fully folded seat-forming position, as will hereinafter be more fully explained.

The folding sofa-bed structure of the present invention includes, on each side, a fixed end frame structure in which a main horizontal frame member 16 of conventional construction is fixedly secured. This frame member, together with a pivotally supported front anchor link 18 and a pivotally supported rear anchor link 20 constitute a supporting base for appropriate linkage assemblies for interconnecting the bed frame structure with the sofa and guiding the movements of certain portions thereof during folding and unfolding operations of the bed frame structure.

As further shown in FIG. 1, the bed frame comprises a plurality of generally rectangular folding sections identified by their side rails, namely, a foot section 22, knee section 24, body or trunk section 26 and head section 28. These sections are connected in end-to-end articulated relation by joint pivots as indicated at 30, 32, and 34 (FIG. 2), respectively. The side rails of the sections and the operative linkage mechanisms are the same and duplicated on opposite sides of the bed frame structure. In the following description, reference will be made to one side only.

The actuating mechanism for the foot and knee sections, as well as the supporting legs, is conventional and includes a bell crank 36 which is rotatably suported at its elbow on the trunk section 26 by a fulcrum pin 38. One end of an actuating link 40 is pivotally connected at 42 to one end of the bell crank. The other end of the link 40 is pivoted at 44 to a folding leg 46 having its inner end hingedly supported on the body section 26.

A second ball crank 48 is fulcrumed on the joint pivot 32 at the connected ends of the knee section and the body section. One end of a locking link 50 is pivoted at 52 to one arm of the bell crank 48, while the other end is pivoted at 54 to the side rail of the foot section 22 in spaced relation to the joint pivot 30. The other arm of the bell crank 48 is formed with an elongate slot 56 to slideably receive a connection pin 58 at one end of a link 60, the other end of this link being provided with a longitudinal slot 62 for slideably receiving a pin 64 on the bell crank 36.

The foot section of the bed frame is supported in its extended position upon an end leg 66 which is pivoted inwardly of its upper end at 68 to the foot section 22, and an actuating link 70 has one end pivoted at 72 to the upper end of link 66, and its other end pivoted at 74 on the knee section 24 in spaced relation to the joint pivot connection 30.

During the folding and unfolding operations of the bed frame structure, the movements of the body section 26 and head section 28 are controlled by means of conventionally associated linkage systems which comprise a rear support linkage assembly B and a front support linkage assembly C. The rear linkage assembly B comprises a rear hanger link 76 which has one end pivoted at 78 at the outer end of the rear anchor link 20, and its other end pivoted at 80 to one end of a rear support link 82, this link having its other end pivotally connected with the joint pivot 34, as best shown in FIG. 2, connecting the body section and head section.

The front support linkage assembly comprises a coordinating link 84, which is pivoted between its ends at a pivot point 86 to the rear support link 82 for relative swinging movement. One end of the coordinating link 84 is connected by a pivot 88 to the outer end of the upper arm of the bell crank 36, and at its other end, which is in right angled relation, is connected with a second link 90 by pivot connection 92. At its other end, the link 90 is connected by a pivot 94 which is inwardly spaced from the pivot 80 at the outermost end of the rear hanger link 76. The outer end of the front anchor link 18 is pivoted at 96 to the coordinating link 84 at a point inwardly adjacent to its pivotal connection 88 with the bell crank 36.

The connected end portion of the link 84 and the bell crank 36 thus become operative elements of the front support linkage assembly C, and the interconnecting links 84 and 90 cooperate to form coordinating connecting means between the rear support linkage assembly B and the front support linkage assembly C, and determine the path of movement of the body frame section in a conventionally known manner during folding and unfolding operations thereof. A tension spring 98 connects at one end with the front anchor link 18 and is anchored at its other end to the horizontal frame member 16. This spring operates in a manner well known in this type of bed construction and is provided to assist the operator in moving the bed frame from the folded seat-forming position to the extended bed-forming position.

Figure 2:
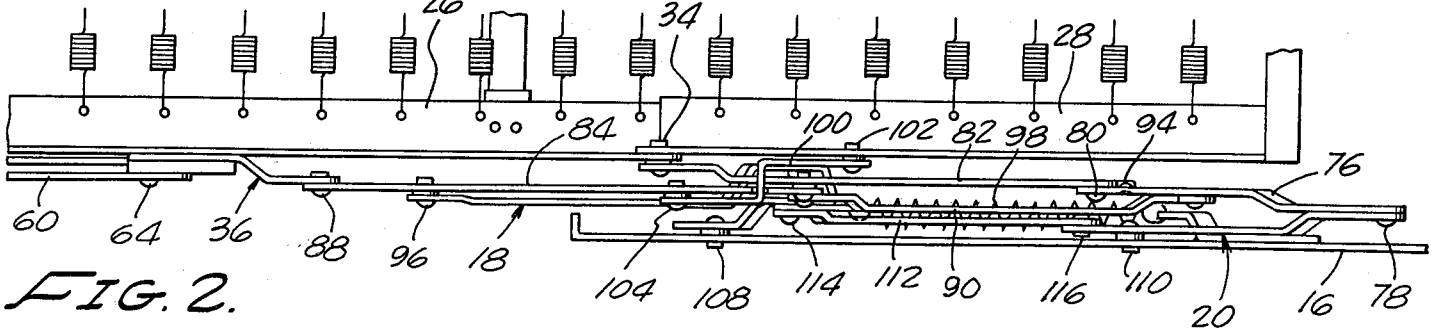
FIG. 2 is an enlarged fragmentary top plan view showing the pivotally connected head section and body section, together with details of the associated actuating linkage mechanism.

Movement of the head section 28 is coordinated with the movements of the body section as determined by the front support linkage assembly and the rear support linkage assembly, by providing a head section actuating link 100 having one end connected to the head section rail at a pivot point 102 which is spaced from the pivot connection 34 of the head section to the body section, as best shown in FIG. 2. The other end of the actuating link 100 is connected by a pivot 104 to the coordinating link 84 at a point spaced from its pivot point 86.

As thus far described, the linkage mechanism is conventional and conforms generally to that disclosed in the Spitz, et al, U.S. Pat. No. 3,868,733, and which coacts to control the movements of the foot and knee sections, and to fold the legs 46 and 66 during folding and unfolding movements of these sections by an operator first grasping a crossbar 106 at the outermost end of the foot section to fold the foot and knee sections into their retracted positions, and by thereafter grasping a crossbar (not shown) transversely connected to the knee section side rails, and by a lifting and closing movement move the bed structure into the sofa frame.

In the present invention, operative objectives and product features are susceptible of attainment by modifying the structures of the front anchor link 18, the rear anchor link 20, and in the provision of unique means for coordinating the action of these elements during folding and unfolding movements of the frame sections.

As best shown in FIGS. 1 and 3–5, the front anchor link 18 is disclosed as comprising a generally L-shaped lever in which a long leg-portion **18*a* is connected at its outer end by the pivot 96 to the coordinating link 84, and a generally right angled short leg-portion 18*b* is connected at its outer end to the forward end of the horizontal frame member 16 at a front pivot point 108. The rear anchor link 20 comprises a rocker lever which is pivoted between its ends upon the horizontal frame member 16 at a rear pivot point 110 which is substantially horizontally aligned with the front pivot point 108. The rear anchor link 20 has a relatively long arm 20*a* which is pivotally connected at its outer end by the pivot 78 with the rear hanger link 76, and a relatively shorter oppositely extending arm 20*b*. The operative movements of the front anchor link 18 and rear anchor link 20 are coordinated and controlled by a connecting link 112 which is connected at one end by a pivot 114 to the short leg 18*b* at a point inwardly of the front pivot point 108. The other end of the connecting link 112 is connected to the outer end of the arm 20*b* by a pivot 116**.

Referring more specifically to FIGS. 3, 4 and 5, the unique operating characteristics of the front anchor link 18, rear anchor link 20 and connecting link 112 will now be described with respect to the movement of the frame sections between folded and unfolded positions and with particular reference to the oriented positions of these elements in the closed, intermediate and open positions of the frame sections.

In general, it will be seen that the configuration of the front anchor link 18, the rear anchor link 20 and the operative connections of the connecting link 112 are such that during the movement between open and closed positions of the bed frame, the pivot 114 will move through a dead center or maximum throw position on one side of a horizontal locus line through the front pivot point 108 to the other side thereof. Also, that during such movement, the long arm **20*a* of the rear anchor link 20 will be moved so that its outer end pivot 78 will traverse an arcuate path 118, as shown in phantom line. This path of movement is disposed entirely on one side of a vertical locus line through the rear pivot point 110. As thus arranged, it will be seen that the rear portion of the bed hangs from the pivot 78 when the bed frame sections are in closed position, and extends forward from the pivot 78 when in opened position. The forward portion of the bed hangs from pivot 96** in both closed and opened positions.

This arrangement provides a unique controlled movement of the pivot point 78 of the rear anchor link 20 in which it will be seen that by selectively locating the pivot 114 on the leg-portion **18*b* of the front anchor link 18, it is possible to control the movement of the pivot 78 along the arcuate path 118 so that the movement will successively be in one direction and then in an opposite direction, while movement of the pivot 96 of the front anchor link is being moved in a single direction only. Thus, it will be seen that in the closed position of the frame sections the pivot pin 78** may be disposed at a point X, at a point Y in the intermediate position, and at a point Z in the open position. Moreover, the physical arrangement is such that it may be readily modified to vary the relative positions of the X, Y and Z points, if desired.

It will be apparent that by locating the position of the pivot 78 at the low point X of the arcuate path in the closed position, the previously stated objective B will be accomplished and that the rear portion of the closed bedframe in relation to the floor will be lower.

By locating the position of pivot 78 at the high point Y on the arcuate path 118 in the intermediate position, the previously stated objective A will be accomplished and that the floor clearance of the frame sections during their articulated folding and unfolding movements will be increased.

Also, by locating the position of the pivot 78 at the lower intermediate point Z on the arcuate path 118 in the open position, the previously stated objective C will be obtained and that the bed frame will be disposed at a more desirable position forward of the associated upholstered back-rest, and at a more desirable height above the floor.

Referring now to FIGS. 6–9, the manner in which the unique arrangement and operation of the front anchor link 18 and the rear anchor link 20 is controlled by the connecting link 112, will now be described with respect to the attainment of the heretofore mentioned product features.

Figure 6:
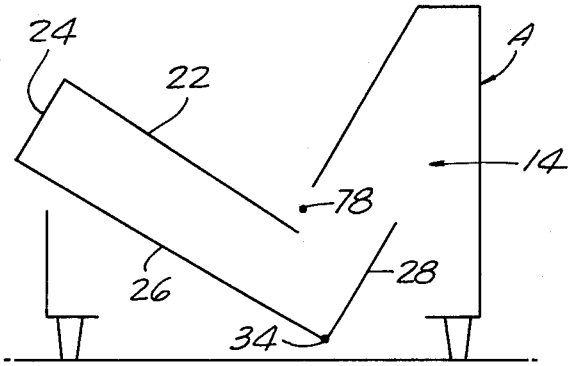
FIG. 6 is a view schematically illustrating the relative orientation of the bed frame sections of a typical mechanism which does not embody the present invention, when moved towards an intermediate position.
Figure 7:
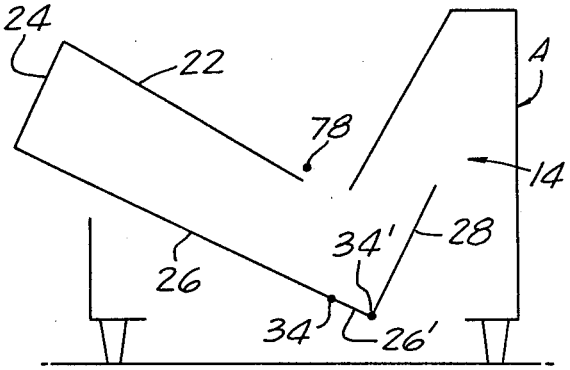
FIG. 7 is a similar view illustrating the manner in which the unique path of movement of the rear anchor link in the present invention increases the clearance of the lowest point of the bed frame from the floor; and permits lengthening of the body section rearwardly beyond its point of attachment to the linkage system in order to lengthen the open bed.

The manner in which the stated product feature No. 1 of being able to lengthen the bed frame structure, will become clearly evident from a consideration of FIGS. 6 and 7. As particularly shown in FIG. 6, in a typical mechanism which does not embody the present invention and wherein the pivot point 78 is fixed, when the body section 26 and head section 28 are pivotally connected by the joint pivot 34 at the outer end of the rear support link 82, a minimum floor clearance during the articulated movement will be obtained as the folded bed sections are moved towards an intermediate position. In the mechanism according to the present invention, as shown in FIG. 7, since the pivot 78, during movement of the bed frame from a closed to intermediate position, is moved upwardly and forwardly from the point X to the point Y, greater floor clearance will be provided, which is a desirable objective. Also, it is possible to obtain additional bed length by extending the body section 26, as indicated at 26', rearwardly of the pivot connection 34 and provide a new joint pivot 34' between the body section and head section.

Additional bed length can also be obtained by lengthening the head section 28. This is possible due to the additional clearance in front of the upholstered seat back, when the bed sections are in extended open position. As will be seen in FIG. 5, the pivot pin 78 is disposed at point Z in the open position of the bed frame, this point being forward of the closed position at point X. Because of this forward displacement distance, it is possible to lengthen the head section accordingly.

Figure 8:
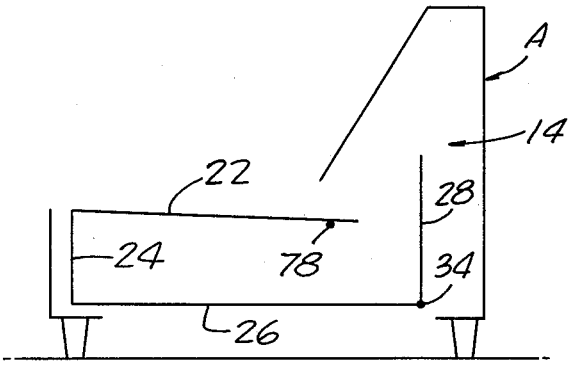
FIG. 8 is a view similar to FIG. 6 showing the relative orientation of the bed frame sections therein, when in a closed folded position.
Figure 9:
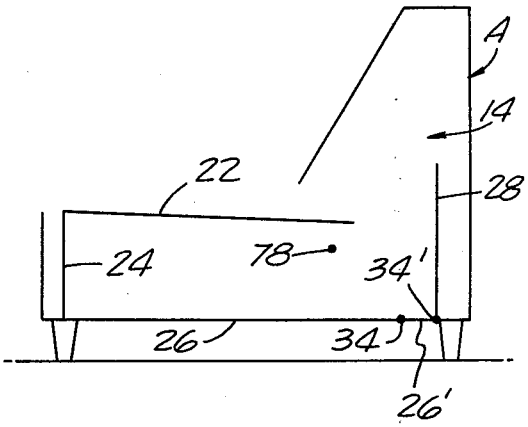
FIG. 9 is a view schematically illustrating the manner in which the unique path of movement of the rear anchor link in the present invention enables the cavity for the folded mattress to be increased in depth.

The manner in which the stated product feature No. 2 of increasing the depth of the mattress cavity of the folded frame structure and retaining a relatively low seat level with desired rake or pitch, will become clearly evident from a consideration of FIGS. 8 and 9. Since the pivot 78 in the closed position of the frame sections is positioned at the relatively lower point X, the bottom of the closed unit will be relatively closer to the floor. This will permit increasing the depth of the mattress cavity or space below the properly pitched sofa seat forming foot section 22.

An additional advantage is obtained in having the pivot point 78 of the rear anchor link 20 move forwardly and upwardly along the arcuate path 118 at a relatively rapid rate of movement as the frame sections are moved from closed to open position. Given this movement of pivot point 78, the head section 28, which is disposed in a generally vertical position in the closed position of the frame sections, can be located in closer proximity to the outside back of the sofa. Accordingly, as pivot point 78 moves quickly forwardly along the arcuate path 118 as the unit is opened, the unfolding head section of the bed can be made to clear the outside back of the sofa.

In contrast to the movement of the outer pivot point at the end of a swingable rear anchor link in the known prior structures, the present invention uniquely provides for accelerating that movement and for increasing the amount of such movement so as to clear the floor at the intermediate stage of articulation. The movement is then reversed to return the pivot point to a desired position for purposes of positioning the open bed.

From the foregoing description and drawings, it will be clearly evident that the delineated objects, objectives and features of the invention will be accomplished.

Various modifications may suggest themselves to those skilled in the art without departing from the spirit and scope of the invention and, hence, it is not wished to be restricted to the specific forms shown or uses mentioned, except to the extent indicated within the appended claims.

I claim:

1. In a folding sofa-bed construction including a bed frame having a plurality of frame sections, one of which is an inner head section and another an adjacent body section, said sections being pivotally interconnected in end-to-end relation for selective unfolding movement to an extended coplanar bed-forming position and folding movement to a folded retracted sofa seat-forming position in which the body section is disposed generally horizontally along the base of the sofa frame and the head section extends generally upright in a space at the rear of the sofa seat behind a back center rail, mechanism for supporting and controlling the movements of said frame sections during movement of the bed frame to said extended and retracted positions, comprising:

(a) a stationary elongate substantially horizontal anchor frame plate;

(b) rear support linkage means pivotally connected between a rear pivot point on said anchor frame plate and a rear portion of said body section, said rear linkage means including an anchor link having a pivotal linkage suspension point of connection at its outer end and being pivoted at its inner end at said rear pivot point;

(c) front support linkage means pivotally connected between a front pivot point of said anchor frame plate and said body section forwardly of the connection of said rear support linkage means, said front linkage means including an anchor link having a pivotal connection at its outer end and being pivoted at its inner end at said front pivot point; and (d) means interconnecting said front and rear anchor links operative during a portion of the swinging movement of said front anchor link in one direction, in response to unfolding and folding movements of the frame sections, to actuate the rear anchor link in a swinging direction opposite to that of the front anchor link.

2. A bed frame structure according to claim 1, in which:

said interconnecting means successively moves the pivotal connection at the outer end of the rear anchor link first in one direction along an arcuate path and thereafter in a reverse direction along said arcuate path in response to an unfolding or folding movement of the frame sections.

3. A bed frame structure according to claim 1, in which:

said interconnecting means comprises a link member having its opposite ends connected respectively on opposite sides of the pivotal mounting points of said front and rear anchor links.

4. A bed frame structure according to claim 1, in which:

said rear anchor link has an inner end projecting beyond said rear pivot point; and said interconnecting means includes a connecting link member having one end pivotally connected with said front anchor link and an opposite end pivotally connected with said projecting inner end of said rear anchor link.

5. A bed frame structure according to claim 4, wherein:

said pivotal connection of the connecting link member with the front anchor link is such that its path of movement, during unfolding and folding movements of the frame sections, passes through a maximum throw position.

6. A bed frame structure according to claim 5, in which:

the direction of axial movement of the connecting link member is reversed in response to said movement through said maximum throw position.

7. A bed frame structure according to claim 1, in which:

said interconnecting means comprises a connecting link member having a pivotal connection with said front anchor link such that the pivotal connection, during unfolding and folding movements of the frame sections, will pass from one side to the other of a locus line between said front and rear pivot points.

8. A bed frame structure according to claim 7, in which:

said front anchor link is of a generally L-shaped configuration with said pivotal connection at its outer end being to its long leg and the pivotal connection at it inner end being to its short leg.

9. A bed frame structure according to claim 8, wherein:

the pivotal connection of said connecting link member to said front anchor link is to said short leg.

10. A bed frame structure according to claim 1 in which:

the outer end of the rear anchor link is first moved in one direction along an arcuate path and thereafter in a reverse direction along said path to a final position corresponding respectively with the fully folded and fully unfolded positions of the frame sections.

11. A bed frame structure according to claim 10, in which:

the point of reversal in the direction of movement of said outer end of the rear anchor link is at a higher elevation than that of the final position.

12. A bed frame structure according to claim 10, in which:

the final position of the outer end of the anchor link for the fully unfolded frame sections is at a higher elevation than the final position for the fully folded frame sections.

13. A bed frame structure according to claim 1, in which:

said interconnected front and rear support linkage means coact, during movement of the bed sections between fully retracted and fully extended positions, to move the body section in a translatory path in which said pivotal linkage suspension point of connection, at the outer end of said rear anchor link, will be moved first in one direction along an arcuate path and thereafter in a reverse direction along said arcuate path to a final position corresponding respectively with the position of the body section in said fully extended and said fully retracted position.

14. A bed frame structure according to claim 13, in which:

the elevation of said suspension point of connection is different at said fully extended and fully retracted positions.

15. A bed frame structure according to claim 14, in which:

the elevation of said suspension point of connection is greater in the fully extended position.

16. A bed frame structure according to claim 13, in which:

said suspension point of connection in said fully extended position is disposed forwardly of its position in said fully retracted position.

17. A bed frame structure according to claim 13, in which:

the point of reversal of the direction of movement of said suspension point of connection is disposed above and forwardly of its final positions.

18. A bed frame structure according to claim 13, in which:

said pivotal connection at the outer end of the front anchor link in said fully retracted position will be disposed forwardly and below said suspension point of connection.

19. A bed frame structure according to claim 13, in which:

said pivotal connection at the outer end of the front anchor links in said fully extended position will be disposed forwardly and above said suspension point of connection.

20. A bed frame structure according to claim 13, in which:

said pivotal connection at the outer end of the front anchor link moves in an arcuate path, as the bed sections are moved between said fully retracted and extended positions, from one side to the other of a vertical locus line extending through said front pivot point.

21. A bed frame structure according to claim 13, in which:

said path of movement of the pivotal linkage suspension point connection at the outer end of said rear anchor link is disposed entirely on one side of a vertical locus line extending through said rear pivot point.

22. A bed frame structure according to claim 1, in which:

said rear support linkage means are pivotally connected with said body section at a point coincident with the pivotal connection of the body section with the head section.

23. A bed frame structure according to claim 1, in which:

said rear support linkage means are pivotally connected with said body section at a point spaced from the point of pivotal connection of the body section with the head section.

24. A bed frame structure according to claim 23, in which:

the pivotal connection of the rear support linkage to the body section is positioned forwardly of the pivotal connection of the body section to the head section.

25. A bed frame structure according to claim 1, in which:

said body section has a portion that extends rearwardly beyond the point of pivotal connections of said rear support linkage therewith.

26. A bed frame structure according to claim 25, in which:

the head section is pivotally connected to the rearwardly extending portion of the body section.

* * * * *